US005350903A

United States Patent [19]

Takei

[11] Patent Number: 5,350,903

[45] Date of Patent: Sep. 27, 1994

[54] COOKING APPLIANCE HAVING A COOLING MECHANISM AND METHOD OF OPERATION

[75] Inventor: Tamotsu Takei, Aichi, Japan

[73] Assignee: Kabushiki Kaisha Toshiba, Kawasaki, Japan

[21] Appl. No.: 88,355

[22] Filed: Jul. 9, 1993

[30] Foreign Application Priority Data

Jul. 21, 1992 [JP] Japan ..... 4-193772

[51] Int. Cl.[5] ..... H05B 6/68

[52] U.S. Cl. ..... 219/716; 219/719; 219/757; 219/492; 126/21 A

[58] Field of Search ..... 219/10.55 G, 10.55 R, 219/10.55 M, 400, 492, 715, 716, 719, 722, 723, 757; 126/21 A; 361/384

[56] References Cited

U.S. PATENT DOCUMENTS

| | | | |
|---|---|---|---|
| 3,808,391 | 4/1974 | Graff et al. | 219/10.55 C |
| 3,867,605 | 2/1975 | Yee | 219/10.55 B |
| 4,547,642 | 10/1985 | Smith | 219/10.55 B |
| 4,628,439 | 12/1986 | Fowler et al. | 219/10.55 B |
| 5,098,665 | 3/1992 | Katschnig et al. | 219/10.55 D |

FOREIGN PATENT DOCUMENTS 63-223422 9/1988 Japan .

*Primary Examiner*—Philip H. Leung

*Attorney, Agent, or Firm*—Cushman, Darby & Cushman

[57] ABSTRACT

A cooking appliance has a cooking compartment accessed by a door. After cooking is finished, a sensor detects the temperature within the cooking compartment. Then a cooling fan cools components in the cooking appliance for a period of time dependent on the detected temperature. A control circuit changes the period for cooling in accordance with the time that the door is open while the fan is on.

9 Claims, 3 Drawing Sheets

COOKING APPLIANCE HAVING A COOLING MECHANISM AND METHOD OF OPERATION

BACKGROUND OF THE INVENTION

The present invention relates to a cooking appliance having a cooking compartment.

A prior cooking appliance, for example, a microwave oven having a cooking compartment and oven cooking function, has a cooling fan. When a user uses the oven cooking function, the temperature within the cooking compartment and around components positioned in an outer case of the oven rises. After oven cooking is finished, the cooling fan cools the components so that their temperature does not exceed their tolerance level.

The cooling time is determined in any of three ways. First, a temperature sensor is positioned adjacent a component which has the lowest temperature tolerance. Until the sensor detects that the temperature is under the tolerance level, the cooling fan continues to cool the components.

Second, a temperature sensor is positioned in the cooking compartment so that the sensor detects the temperature within the cooking compartment. Until the sensor detects that the temperature is less than a predetermined temperature, the cooling fan continues to cool the components. The predetermined temperature is set to a presumptive value at which the temperature of all components is presumed to be under the tolerance level.

Third, a cooling time is determined in accordance with the temperature set by a user for oven cooking. The cooling fan cools the components for the determined cooling time.

However, the first approach requires the sensor to be attached to the component, increasing manufacturing costs.

With the second approach, if a door to the cooking compartment is opened while the cooling fan is actuated, the temperature within the cooking compartment drops rapidly. As a result, since the temperature drops under the predetermined temperature, the cooling fan stops cooling the 10 components. Although the temperature drops under the predetermined temperature, the temperature of the components often does not drop enough. As a result, the cooling time is too short.

With the third approach, if the door is open while the cooling fan is running, the compartment is efficiently cooled by the outside air. As a result, although less cooling time is required, the cooling fan continues to run. Therefore, the cooling fan operates unnecessarily for a certain time.

SUMMARY OF THE INVENTION

It is an object to provide a cooking appliance and method of operation which can cool components for a proper period, while minimizing manufacture costs.

In order to achieve the above object in the present invention, the period of time that a door of a cooking compartment of a cooking appliance is open during cooling is monitored. The period of time that a cooling fan is operated during cooling is changed in accordance with the time the door is open.

BRIEF DESCRIPTION OF THE DRAWINGS

These and other objects and advantages of this invention will become apparent and more readily appreciated from the following description of the presently preferred exemplary embodiments, taken in conjunction with the accompanying drawings, of which.

DETAILED DESCRIPTION OF THE PRESENTLY PREFERRED EXEMPLARY EMBODIMENTS

Embodiments in which the present invention are employed in a microwave oven with an oven cooking function will be described with reference to the drawings.

Figure 2:
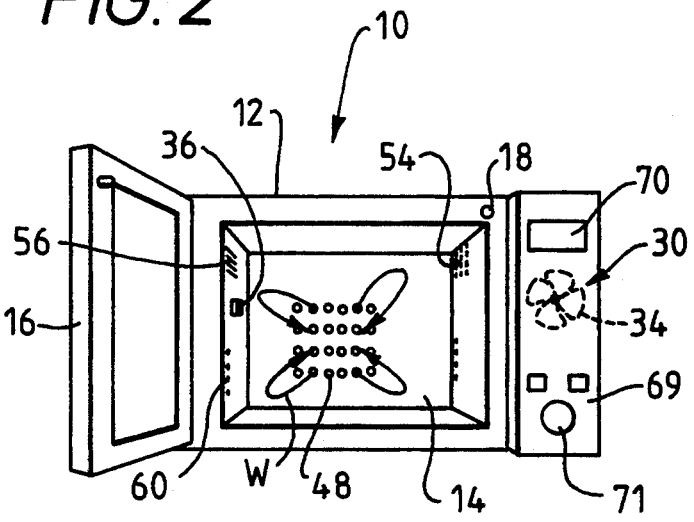
FIG. 2 is a front view of the cooking appliance.

With reference to FIG. 2, a microwave oven 10 has an outer case 12. A cooking compartment 14 for receiving food is located in outer case 12. A door 16 is pivotally provided in front of cooking compartment 14.

A door switch 18, which detects whether door 16 is open, is located on a front edge of cooking compartment 14. When door 14 is closed, door switch 18 contacts with the door.

Figure 3:
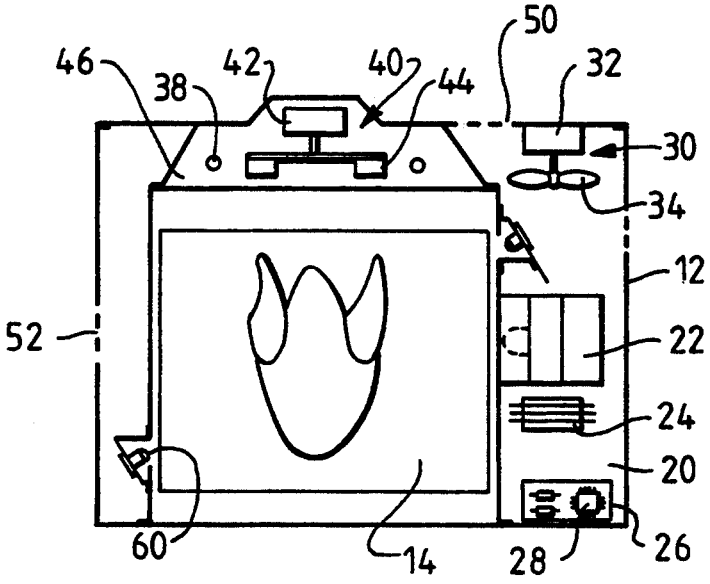
FIG. 3 is a cross section of the cooking appliance.

With reference to FIG. 3, a components compartment 20 is provided between outer case 12 and cooking compartment 14. A magnetron 22, which generates microwaves to be supplied to cooking compartment 14, a transformer 24 and a printed circuit board 26 on which a microcomputer 28 is provided, are located in components compartment. A cooling fan 30 including a motor 32 and a fan 34 is provided near magnetron 22 in components compartment 20.

A temperature sensor 36 which detects the temperature within cooking compartment 14 is located on a side wall of the cooking compartment. An oven heater 38 and a circulation device 40, including a motor 42 and a fan 44, are located behind in a rear portion 46 cooking compartment 14.

During oven cooking, oven heater 38 heats air within rear portion 46. Circulation device 40 causes the heated air to circulate in cooking compartment 14 through holes 48 as shown by arrows W in FIG. 2 so that the temperature within cooking compartment 14 increases gradually.

Figure 4:
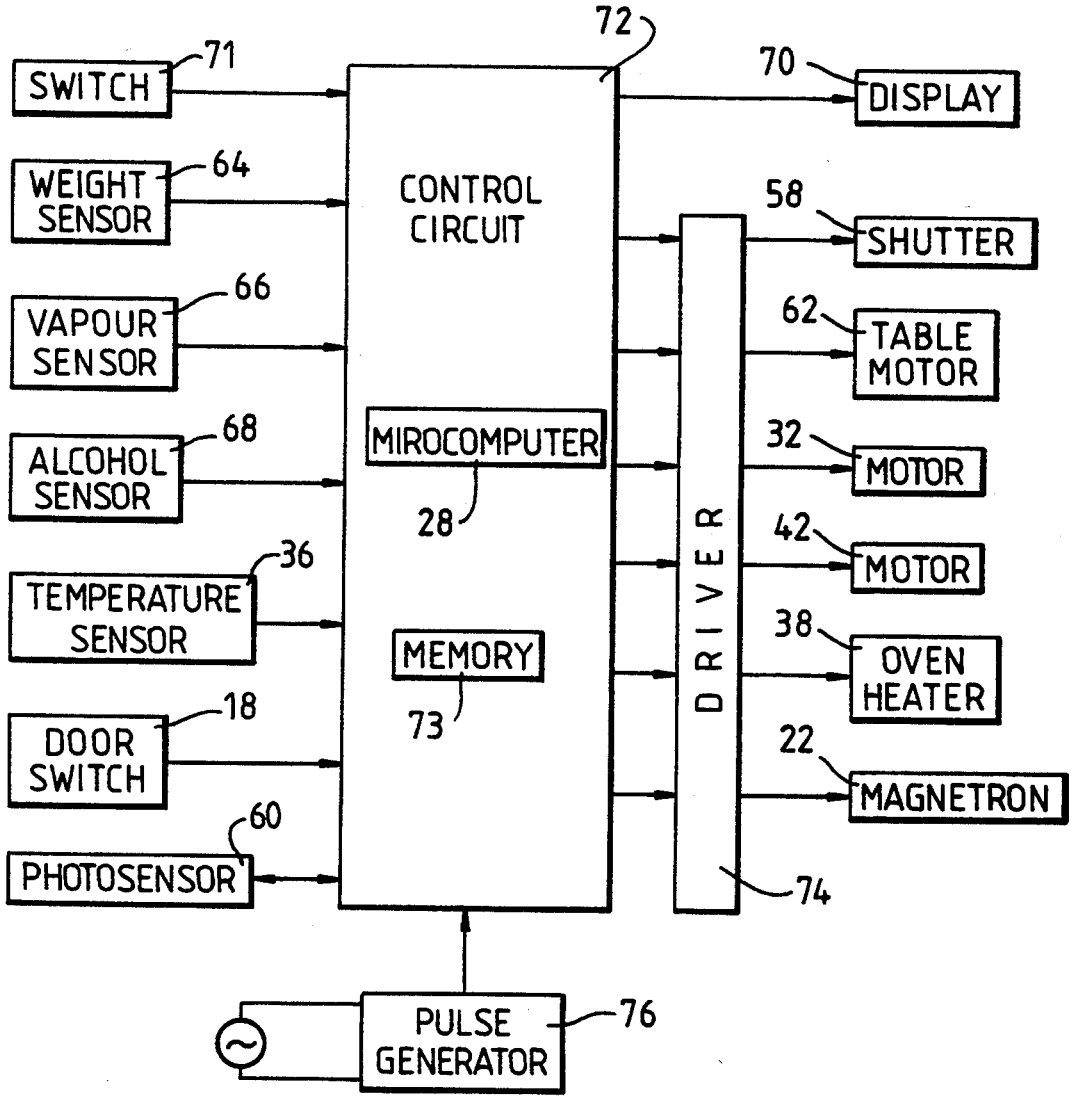
FIG. 4 is a block diagram of the circuitry of the cooking appliance.

An air intake hole 50 and an exhaust hole 52 are provided on outer case 12. An air inlet 54 and an air outlet 56 are provided on cooking compartment 14. A shutter 58 (as shown in FIG. 4) is located on air inlet 54, which can shut the air inlet based on a command from microcomputer 28.

When motor 32 rotates fan 34, outside air is drawn into components compartment 20 through intake hole 50. After the air cools magnetron 22 and other components, the air flows into cooking compartment 14 through air inlet 54 because shutter 58 is open. The air within cooking compartment 14 is exhausted through air outlet 56 and exhaust hole 52.

Four pairs of photosensors 60, which detect the shape or height of food, are positioned on the side wall of cooking compartment 14. Photosensors 60 are also cooled by the air from fan 34.

During microwave cooking, a rotatable and detachable plate (not shown) is positioned on a bottom portion within cooking compartment 14. The plate is rotated by a table motor 62 (see FIG. 4). A weight sensor 64 provided under cooking compartment 14 weighs food placed on the plate.

A vapor sensor 66, which detects vapor generated by cooking food, is positioned between air outlet 56 and exhaust hole 52. An alcohol sensor 68, which detects alcohol generated by the food is positioned near vapor sensor 66.

An operation panel 69 is positioned on a front surface of outer case 12. A display 70 which indicates cooking mode and time is located on operation panel 69. Plural kinds of switch 71 such as a start switch is located on operation panel 69.

With reference to FIG. 4, a control circuit 72 including microcomputer 28 has a memory 73. Microwave oven 10 is controlled based on a program stored in memory 73. Switch 71, weight sensor 64, vapor sensor 66, alcohol sensor 68, temperature sensor 36, door switch 18 and a pulse generator 76 are connected and send signals to control circuit 72. Control circuit 72 sends commands to photosensors 60 and receives signals detected by them. Control circuit 72 directly controls display 70, and controls magnetron 22, oven heater 38, motors 42, 43 and 62 and shutter 58 through a driver 74.

For oven cooking, a user makes the appropriate selections using switches 71 and sets both a desired temperature within cooking compartment 14 and a cooking time. When the user presses a start switch, oven heater 38 heats air within rear portion 46 and fan 44 circulates the heated air through holes 48. Until a temperature within cooking compartment 14 reaches the predetermined value as set by the user, oven heater 38 and motor 42 are energized continuously. After that, heater 38 and motor 42 are energized intermittently so that the temperature 10 is maintained at the set temperature.

Figure 1:
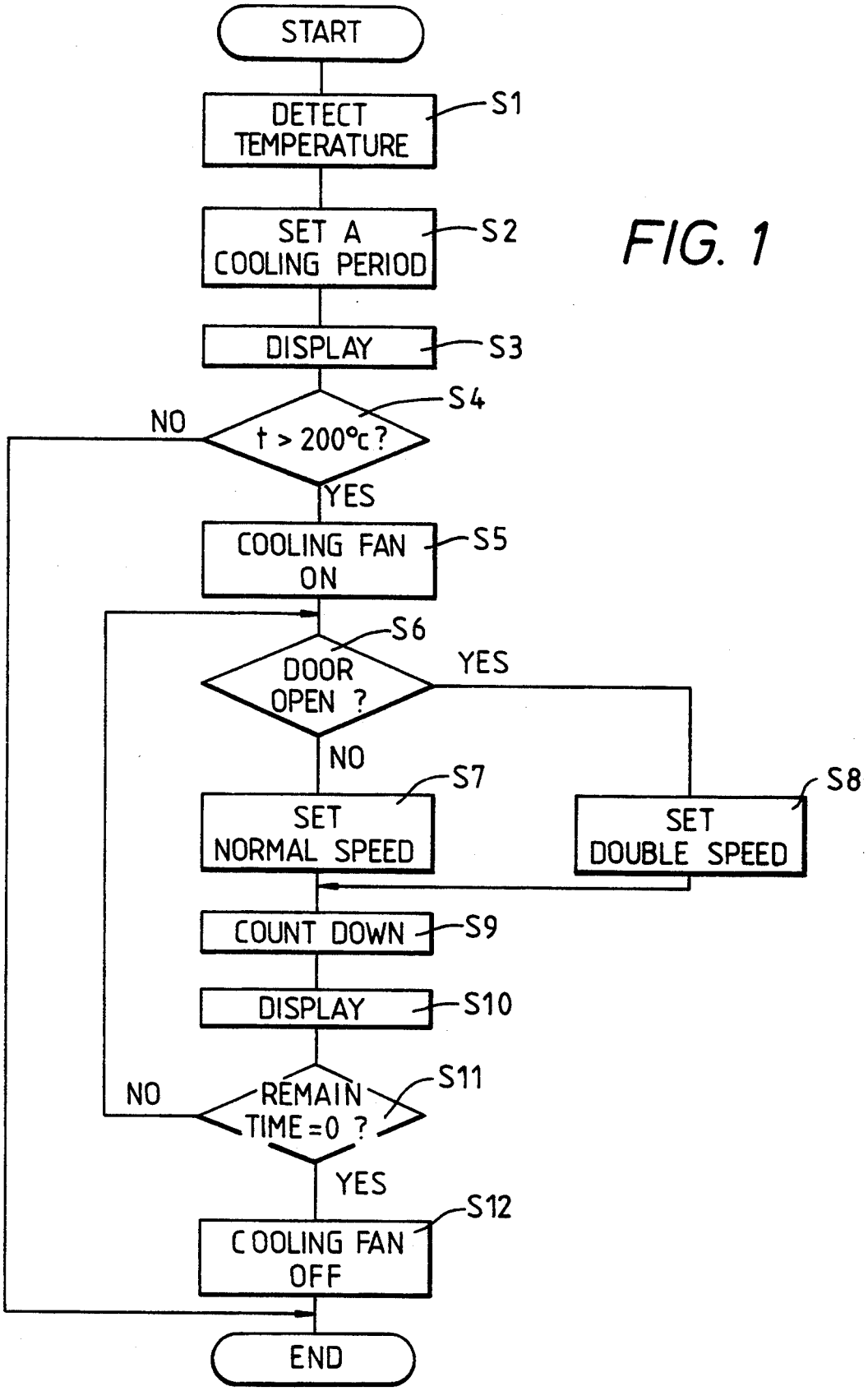
FIG. 1 is a flow chart illustrating operation of a cooking appliance according to the present invention.

After oven cooking is finished or cancelled during cooking, cooling fan 30 cools the components such as magnetron 22, photosensors 60, and print circuit board 26. FIG. 1 is a flow chart illustrating the operation of cooling fan 30 after cooking is finished. The operation is based on the program stored in memory 73. When oven cooking is finished, temperature sensor detects a temperature within cooking compartment 14 (step S1). Control circuit 72 determines a cooling period based on the temperature (step S2). Display 70 displays the cooling period (step S3).

Figure 5:
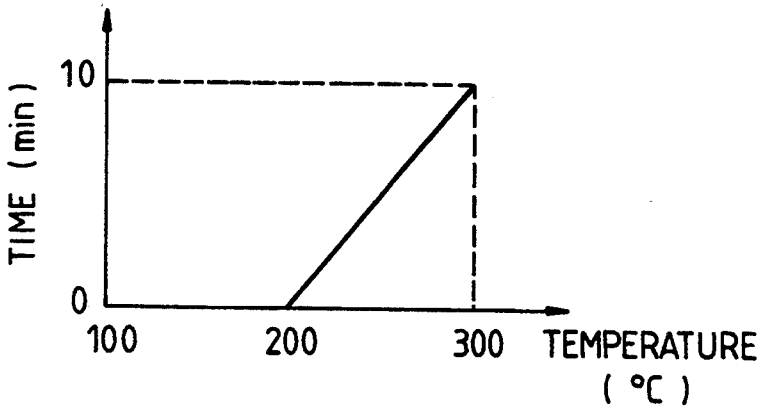
FIG. 5 shows a graph showing a connection between the temperature of a cooking compartment and a cooling time.

In this case, control circuit 72 determines the cooling period based on FIG. 5, which illustrates the relation between the temperature in cooking cabinet 14 and a cooling time. Data in accordance with FIG. 5 are stored in memory 73 as a time table.

As a specific example, a cooling period is set for ten minutes when the temperature in the oven is 300° C. and the cooling period is set for 0 minutes when the temperature is 200° C. A relation between the temperature and a cooling period is linear when the temperature is in a range between 200° C. and 300° C. When the temperature is under 200° C., the cooling fan 30 does not operate.

Control circuit 72 determines whether the temperature exceeds 200° C. (step S4). If not, processing is finished. If so, the cooling fan 30 begins to cool the components (step S5). Control circuit 72 determines whether door 16 is open based on a signal from door switch 18 (step S6). If door 16 is closed, control circuit 72 causes the cooling period to be counted at a normal speed (step S7). In detail, when control circuit 72 receives 50 pulses from pulse generator 76, the control circuit causes the remaining cooling period to be decreased by one second.

If door 16 is open, control circuit 72 sets a counting speed of the cooling period as twice the normal speed (step S8). In detail, when control circuit 72 receives 25 pulses from pulse generator 76, the control circuit causes the remaining cooling period to be decreased by one second.

Therefore, when the normal speed is set, one second on display 70 indicates one second of actual time. When the double speed is set, one second on display 70 indicates 0.5 seconds of actual time.

Control circuit 72 begins to count down the remaining cooling period (step S9). Display 70 displays the remaining time in the cooling period (step S10). Then, control circuit 72 determines whether the cooling period has expired (step S11). If not, flow returns to step S6. If so, cooling fan 30 stops rotating and the display of cooling time on display 70 is discontinued (step S12).

According to the embodiment, the cooling period is set based on the temperature within cooking compartment 14 when cooking has finished. If door 16 is open while cooling fan 30 cools the components, the cooling period is shorten based on the time that the door is open. When door 16 is open, cooking compartment 14 is directly cooled by outside air efficiently. As a result, any previously set cooling time would be longer than necessary enough.

Therefore since, in the present invention, the cooling period is changed when door 16 is open, cooling fan 13 can cool the components for a proper period.

Since temperature sensor 36 detects the temperature within cooking compartment 14, the temperature sensor can be used both for determining the cooling period and maintaining a predetermined temperature during oven cooking.

Although only one embodiment has been described in detail above, those skilled in the art will readily understand that many modifications are possible in the preferred embodiment without departing from its teachings.

For example, although the embodiment describes a linear relationship between the temperature and the cooling period, of course the relationship could be on multiple steps. When an additional timer is used separately from microcomputer 28, the counting speed may be altered by changing the frequency ratio of this timer's frequency divider.

When door 16 is open, the counting speed may be altered to something other than double the normal speed. Temperature sensor 36 may detect the temperature within components compartment 20 or rear portion 46.

All such modifications are intended to be encompassed within the following claims.

What is claimed is:

1. A cooking appliance, comprising;

a) a cooking compartment for receiving food;

b) a door, which is coupled to the cooking compartment, for accessing the cooking compartment;

c) means, coupled to the cooking compartment, for heating food received in the cooking compartment;

d) a cooling fan for cooling the cooking compartment;

e) means for determining how long the door is open; and f) means, responsive to the determining means, for changing period for operating the cooling fan in relation to how long the determining means determines that the door is open.

2. A cooking appliance comprising:

a) a cooking compartment for receiving food;

b) a door, coupled to the cooking compartment, for accessing the cooking compartment;

c) means, coupled to the cooking compartment, for heating food received in the cooking compartment;

d) a cooling fan, coupled to the cooking compartment, for cooling the cooking compartment;

e) means, coupled to the cooking compartment, for determining if the door is open; and f) means for reducing a period for operating the cooling fan as the door is open for a longer amount of time.

3. A cooking appliance comprising:

a) a cooking compartment for receiving food;.

b) a door, coupled to the cooking compartment, for accessing the cooking compartment;

c) means, coupled to the cooking compartment, for heating food received in the cooking compartment;

d) a cooling fan, coupled to the cooking compartment, for cooling the cooking compartment;

e) means, coupled to the cooking compartment, for determining if the door is open;

f) means for detecting a temperature within the cooking compartment and for determining an initial period for operating the cooling fan based on the temperature; and g) means for changing the initial period for operating the cooling fan based on the determination made by the determining means.

4. A cooking appliance according to claim 3, wherein the initial period determining means increases the initial period as the temperature becomes higher, and the changing means reduces the period for operating the cooling fan as the amount of time the door is open becomes longer.

5. A cooking appliance, comprising:

a) an outer case;

b) a cooking compartment in the outer case for receiving food;

c) a door, coupled to the outer case, for accessing the cooking compartment;

d) at least one component between the outer case and the cooking compartment;

e) means, coupled to the outer case, for cooling the at least one component;

f) temperature detecting means, coupled to the outer case, for detecting the temperature within the outer case;

g) means, coupled to the temperature determining means and the cooling means, for determining a period for operating the cooling means based on the temperature;

h) means, coupled to the period determining means, for counting the period;

i) open door determining means, coupled to the outer case, for determining if the door is open; and j) means, coupled to the period counting means and the open door determining means, for changing a counting speed of the counting means in accordance with the determination made by the open door determining means.

6. A cooking appliance according to claim 5, wherein changing means increases the counting speed of the counting means while the door is open.

7. A cooking appliance, comprising:

a) an outer case;

b) a cooking compartment, located in the outer case, for receiving food;

c) a door, coupled to the outer case, for accessing the cooking compartment;

d) at least one component between the outer case and the cooking compartment;

e) cooling means, coupled to the cooking compartment, for cooling the component after cooking is finished;

f) temperature detecting means, coupled to the cooking compartments, for detecting the temperature within the cooking compartment;

g) period determining means, coupled to the cooling means and the temperature detecting means, for determining a period for operating the cooling means based on the temperature detected by the temperature detecting means;

h) counting means, coupled to the period determining means, for counting the period;

i) open door detecting means, coupled to the outer case, for detecting if the door is open; and j) means, coupled to the counting means and the open door detecting means, for increasing a counting speed of the counting means while the door is open.

8. A cooking appliance according to claim 7, wherein the increasing means doubles the counting speed of the counting means while the door is open.

9. A method of controlling a cooling fan in a cooking appliance having a cooking compartment, comprising the steps of:

detecting the temperature within the cooking compartment;

determining a period of time for operating the cooling fan based on the detected temperature;

determining how long a door of the cooking compartment is open; and changing the determined period of time in accordance with the determination of how long the door is open.

* * * * *